United States Patent [19]

Demers

[11] Patent Number: 4,679,658

[45] Date of Patent: Jul. 14, 1987

[54] GAFF

[75] Inventor: Harlan Demers, Dalton, Ohio

[73] Assignee: Koppers Company, Inc., Pittsburgh, Pa.

[21] Appl. No.: 751,872

[22] Filed: Jul. 5, 1985

[51] Int. Cl.[4] ..... A63B 27/00

[52] U.S. Cl. ..... 182/221; 182/134

[58] Field of Search ..... 182/221, 134; 248/216.1; 36/113, 136

[56] References Cited

U.S. PATENT DOCUMENTS

| | | | |
|---|---|---|---|
| 927,367 | 7/1909 | Marshall | 248/216.1 |
| 1,981,755 | 11/1934 | Serene | 182/221 |
| 2,835,426 | 5/1958 | Terry | 182/221 |
| 3,025,927 | 3/1962 | Stein | 182/221 |
| 3,848,080 | 11/1974 | Schmidt | 248/216.1 |
| 3,867,998 | 2/1975 | Joseph | 182/221 |

FOREIGN PATENT DOCUMENTS

| | | | |
|---|---|---|---|
| 719977 | 4/1942 | Fed. Rep. of Germany | 248/216.1 |

*Primary Examiner*—Reinaldo P. Machado
*Attorney, Agent, or Firm*—Daniel J. Long; Donald M. MacKay; Herbert J. Zeh, Jr.

[57] ABSTRACT

A gaff is provided for use in climbing a wooden utility pole (to include trees), said gaff having one or more grooves preferably running along a line parallel to the line formed by the intersection of the planes of its top two sides and/or one or more teeth for cutting into the pole.

11 Claims, 10 Drawing Figures

GAFF

BACKGROUND OF THE INVENTION

This invention relates to gaffs for climbing utility poles and trees.

Heretofore, utility poles have been impregnated with various preservatives some of which render the wood hard and resistant to penetration by climbers gaffs. As a result the lineman, being unable to easily insert the gaff of his climbing iron into the pole, does not have ample support, thus, increasing climbing hazards.

SUMMARY OF THE INVENTION

It has now been discovered that an improved gaff is provided having one or more grooves preferably running along a line parallel to the line formed by the intersection of the planes of its top two sides and/or one or more toothed sections or teeth for removing wood from the outer surface of the pole.

DETAILED DESCRIPTION OF THE INVENTION

Figure 1:
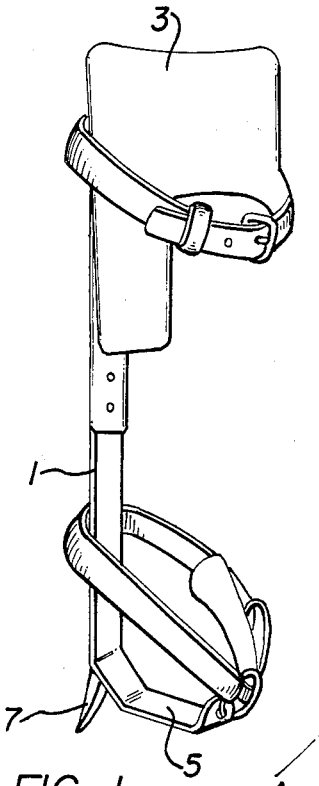
FIG. 1 is a perspective view illustrating a climbing iron for use with the invention.

Referring now to FIG. 1, the gaff 7 is affixed to a climbing iron 1 comprising an upstanding portion 3 which is adapted to engage the climber's boot or shoe, and a stirrup 5 to support the weight of the climber. The gaff is for penetrating the pole (used herein to include trees) whereupon the climber is supported. The gaff can be fixed or removable for replacement.

Figure 2:
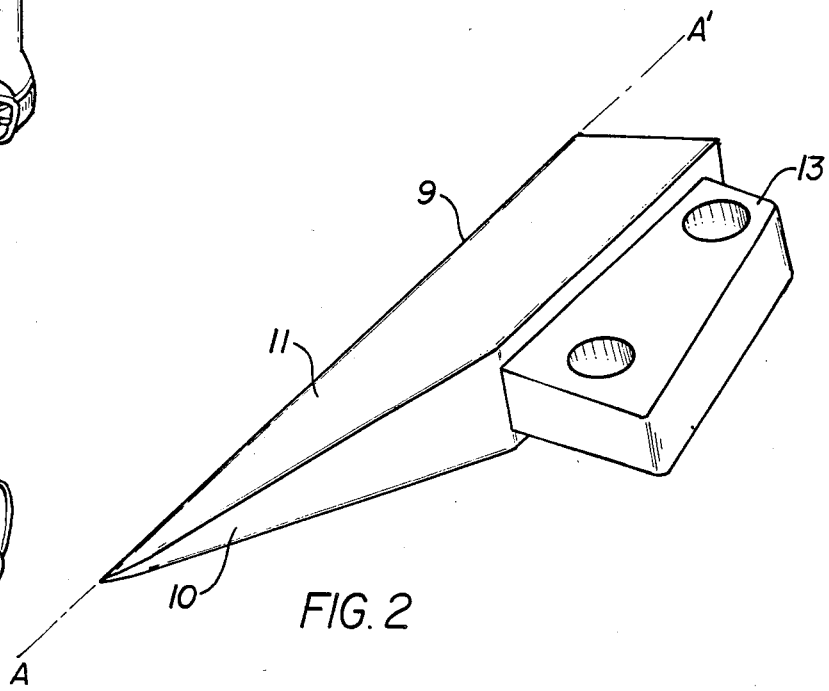
FIG. 2 is an isometric view of the gaff.

In FIG. 2, an isometric drawing of a replaceable gaff is shown wherein 9 is the ridge line of the top surface, 10 is the bottom surface, 11 is one-half of the top surface and 13 is the gaff support.

Figure 3:
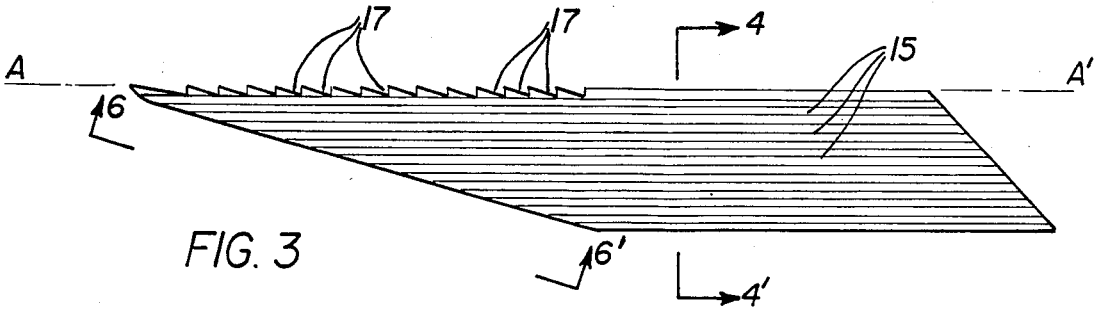
FIG. 3 is a detailed view of one-half of the top surface of the gaff.
Figure 4:
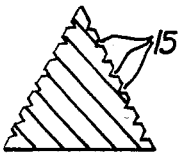
FIG. 4 is a cross sectional view of V type grooves parallel to line A—A' taken along line 4—4' in FIG. 3.

In FIG. 3, a detailed view is shown of one-half of the top surface of gaff 7 wherein the lines 15, preferably running parallel to line A—A' are grooves preferably running substantially the length of gaff 7 and are illustrated in cross section in FIG. 4. Teeth 17 which are symmetrical about line A—A' extend from a point near the tip of the gaff (e.g. $\frac{1}{4}''$ from tip) to a point near the maximum insertion of the gaff into the wood or a point about $1\frac{1}{2}''$ from the tip with a conventional gaff of $1\frac{3}{4}''$.

Figure 7:
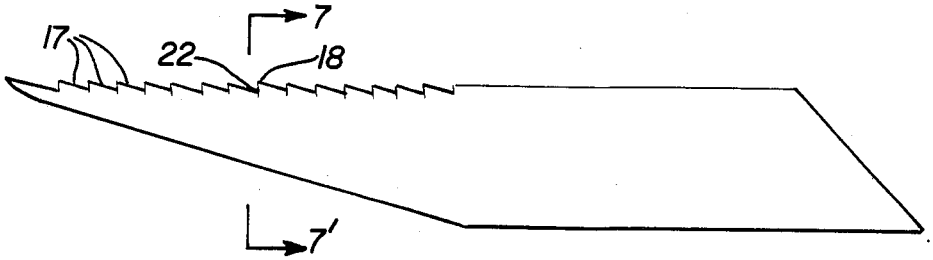
FIG. 7 is a view of teeth taken along A—A' in FIG. 2 forming a saw type edge for cutting pole.
Figure 9:
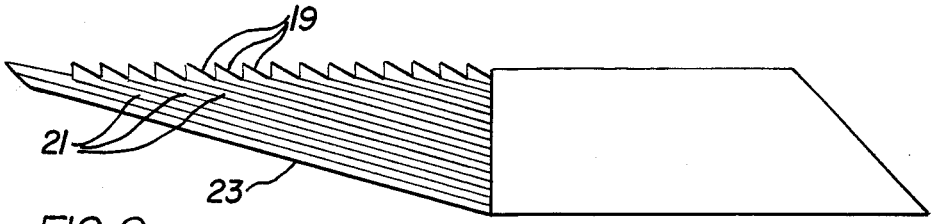
FIG. 9 is a detailed view of one-half of the top surface of the gaff with grooves parallel to the bottom of the gaff.
Figure 10:
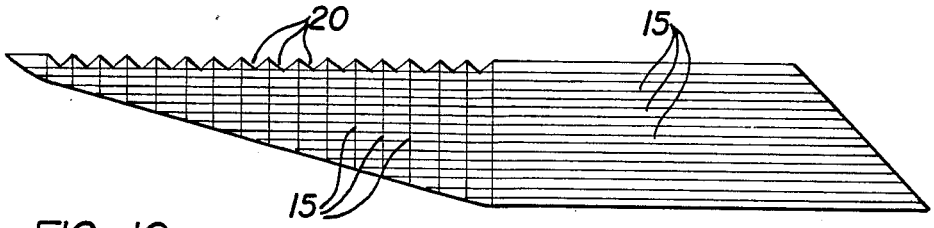
FIG. 10 is a view of one-half of the gaff with criss-crossed v grooves forming saw like surface and intersecting with Line A—A' in FIG. 2.

These teeth 17 are shown in FIGS. 3 and 7. Different shaped teeth 19 and 20 are shown in FIGS. 9 and 10, respectively. The teeth dig into the utility pole and are believed to relieve resistance to gaff penetration by abrasive action. The V shaped grooves 15 are believed to help maintain gaff drive direction and may provide up to 90-95% more support area than the conventional gaff will for the same gaff penetration.

Figure 5:
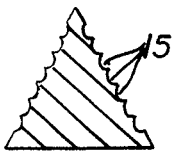
FIG. 5 is a cross sectional view of semicircular type grooves parallel to line A—A' in FIG. 3 taken along line 4—4'.
Figure 6:
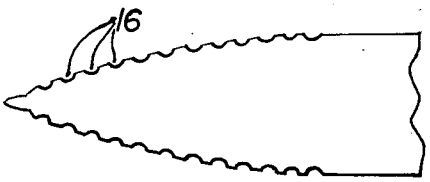
FIG. 6 is a sectional view taken along line 6—6' in FIG. 3 of teeth formed by intersecting grooves with bottom surface of gaff.

In FIG. 5, a cross secional view of semi-circular type grooves 15 is shown. FIG. 6 shows a sectional view of teeth formed on the bottom edge of gaff.

Figure 8:
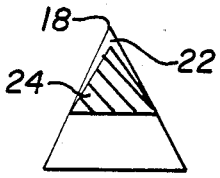
FIG. 8 is a cross-sectional view of the gaff showing the shape of a cutting tooth at section 7—7' in FIG. 7.

In FIG. 8, a cross sectional view of a tooth is shown taken across line 7—7' in FIG. 7 wherein 18 is the top of tooth and 22 shows the cutting surface of the tooth. The cross hatched area 24 is the remaining gaff cross section at section 7—7'. To obtain optimum results, a plurality of grooves are formed on the gaff with the teeth 17 (FIG. 3) contiguous with and feeding into V shaped grooves 15. The grooves may take other shapes such as the semi-circular grooves 14 shown in FIG. 5 and may run in any direction. For best results the groove should be present in the area from the tip of the gaff to $\frac{1}{2}''$ from the tip.

The depth of the grooves will depend upon the additional support and drive direction desired. Generally, the grooves are from 1/64" to 3/16" deep. The depth and angle of the teeth are dependent upon the degree of cutting surface required. Depending upon the preference and/or weight of the climber, the teeth may comprise as little as $\frac{1}{4}''$ near the tip of the gaff to the full length.

While some improvement is obtained with either the teeth or the grooves used alone, it is preferred that they be employed together. Similarly, the number of grooves on the gaff need not be the maximum which can be machined but only so many need be employed to obtain the desired support and ease of penetration into the pole. The gaff is typically made of steel but any sufficiently rigid material can be employed.

In FIG. 9, an alternative embodiment is shown in which grooves 21 are parallel to bottom anterior surface 23.

In FIG. 10, an alternative embodiment is shown in which V grooved sections 15 run both parallel and perpendicular to line A—A' in FIG. 3.

What is claimed is:

1. A gaff for use in a climbing iron for climbing a wooden pole or tree, said gaff having at least one groove on the part of the gaff that is inserted into the pole or tree wherein the gaff has a plurality of grooves and the gaff is prismatic in shape and has two top sides and a line formed by the intersection of the planes of said two top sides and grooves along a line parallel to the line formed by said intersection.

2. A gaff for use in a climbing iron for climbing a wooden pole or tree, said gaff having at least one tooth for cutting into the pole or tree wherein said gaff is triangular in shape with two top sides and with a line running parallel to the intersection of the planes of its two top sides, and wherein it has a plurality of teeth running perpendicular to said line.

3. A gaff having at least one groove on the part of the gaff that is inserted into the pole or tree and wherein said gaff is triangular in shape and has two top sides and a line formed by the intersection of the planes of said two top sides and wherein it has a plurality of grooves running along lines parallel to the line formed by said intersection and a pluralty of teeth perpendicular to a line formed by said intersection.

4. A gaff having at least one groove on the part of the gaff that is inserted into the pole or tree and wherein said gaff is triangular in shape and has two top sides and a line formed by the intersection of the planes of said top two sides and wherein it has a plurality of grooves running along lines parallel to the line formed by said intersection and a plurality of teeth on the bottom edge.

5. A gaff having a bottom anterior surface with a line parallel to said bottom anterior surface and having at least one groove running along said line parallel to the bottom anterior surface.

6. The gaff of claim 5, wherein the gaff has a plurality of said grooves.

7. A gaff, triangular in shape, with two top sides and a line formed by the intersection of the planes of said top two sides having at least one groove running along a line perpendicular to the line formed by said intersection.

8. The gaff of claim 7 comprising a plurality of said grooves.

9. The gaff of claim 8 additionally comprising a plurality of grooves running along a line parallel to said line formed by the intersection of the planes of its top two sides.

10. The gaff of claim 7 additionally comprising at least one saw-like tooth for cutting into a pole or tree.

11. The gaff of claim 10 comprising a plurality of said teeth.

* * * * *